US007162190B2

(12) United States Patent
Deguchi

(10) Patent No.: US 7,162,190 B2
(45) Date of Patent: Jan. 9, 2007

(54) TONER FEEDER

(75) Inventor: Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/333,204

(22) Filed: Jan. 18, 2006

(65) Prior Publication Data

US 2006/0165441 A1 Jul. 27, 2006

(30) Foreign Application Priority Data

Jan. 24, 2005 (JP) ..... 2005-016015

(51) Int. Cl.
*G03G 15/08* (2006.01)

(52) U.S. Cl. ..... 399/258; 399/27; 399/99; 399/106; 399/254; 399/260; 399/262; 399/264

(58) Field of Classification Search ..... 399/99, 399/27, 106, 254, 255, 258, 260, 262, 265
See application file for complete search history.

(56) References Cited

U.S. PATENT DOCUMENTS

| | | | | |
|---|---|---|---|---|
| 4,519,693 | A * | 5/1985 | Skeels | 399/262 |
| 4,592,642 | A * | 6/1986 | Imaizumi et al. | 399/27 |
| 4,963,939 | A * | 10/1990 | Kurando et al. | 399/12 |
| 5,049,938 | A * | 9/1991 | Ueda | 399/29 |
| 5,075,724 | A * | 12/1991 | Wada et al. | 399/12 |
| 5,913,091 | A * | 6/1999 | Nanba et al. | 399/32 |

FOREIGN PATENT DOCUMENTS

| | | | |
|---|---|---|---|
| JP | 9-218575 | | 8/1997 |
| JP | 2001-235936 | | 8/2001 |
| JP | 2001235936 | A * | 8/2001 |
| JP | 2004-264432 | | 9/2004 |
| JP | 2004264432 | A * | 9/2004 |

* cited by examiner

*Primary Examiner*—David M. Gray
*Assistant Examiner*—Geoffrey T Evans
(74) *Attorney, Agent, or Firm*—Nixon & Vanderhye, P.C.

(57) ABSTRACT

The toner feeder is removably mounted in an image forming apparatus including a rotation driver for rotating a toner container and a rotation controller for controlling the rotation driver. The toner feeder comprises a toner container for containing toner, and a support holder which holds the toner container in an axially rotatable manner. The toner container has a toner outlet port and a magnetic member provided on an outer peripheral surface thereof. The support holder includes magnetism detection means which detects passage of the magnetic member and outputs a detection signal to the rotation controller. The rotation controller controls the rotation driver so as to stop the toner container with the toner outlet port oriented upward with respect to a gravity direction on the basis of the output of the magnetism detection means after the toner container is rotated by the rotation driver to feed out a predetermined amount of toner from the toner outlet port.

4 Claims, 14 Drawing Sheets

(a)

(b)

(c)

(d)

TONER FEEDER

CROSS-REFERENCE TO RELATED APPLICATIONS

This application is related to Japanese patent application No. 2005-16015 filed on Jan. 24, 2005, whose priority is claimed under 35 USC § 119, the disclosure of which is incorporated by reference in its entirety.

BACKGROUND OF THE INVENTION

1. Field of the Invention

The present invention relates to a toner feeder and, more specifically, to a toner feeder for supplying toner to a developing device of an image forming apparatus.

2. Description of the Related Art

A toner feeder of the prior art related to the present invention is adapted to read information recorded on a bar code attached to a peripheral surface of a toner container bottle by an optical sensor to detect the specifications of the toner container bottle (see, for example, Japanese Unexamined Patent Publication No. 2001-235936).

Image forming apparatuses such as a copying machine, a facsimile machine and a printer utilizing an electrophotographic system typically include a photosensitive drum on which an electrostatic latent image is formed by laser irradiation means or the like, and a developing device provided in the vicinity of the photosensitive drum for developing the electrostatic latent image with toner. In such an image forming apparatus, a toner feeder (toner cartridge) is removably mounted for supplying the toner to the developing device.

Where the developing device employs a two-component developing agent containing a toner and a carrier such as iron powder, for example, the toner and the carrier are stirred to be homogeneously mixed in a stirring chamber, and the resulting two-component developing agent is transported to the vicinity of a developing roller incorporating a magnetic member.

The developing agent transported to the vicinity of the developing roller is carried on a surface of the developing roller by a magnetic field of the developing roller to provide a so-called magnetic brush. When the magnetic brush is brought into opposed relation to the photosensitive drum, only negatively charged toner is transferred onto the photosensitive drum to develop the electrostatic latent image. When the carrier separated from the toner thereafter passes through a repulsive magnetic field of the developing roller, the carrier falls back into the stirring chamber of the developing device.

Therefore, the toner concentration of the developing agent in the developing device is gradually reduced during repeated image formation. The reduction of the toner concentration is detected by a sensor provided in the developing device. In response to the detection, a toner hopper in which the toner is preliminarily stirred for easy mixing of the toner with the developing agent is driven to supply the toner to the developing device. When the toner concentration is recovered to a predetermined concentration level, the driving of the toner hopper is stopped.

When the amount of the toner in the toner hopper is reduced to less than a predetermined level, the reduction of the toner amount is detected by a sensor provided in the toner hopper, and a developing agent feeder is driven. That is, a toner container bottle is rotated to supply toner into the toner hopper from a toner outlet port thereof. When the toner is supplied to the predetermined level, the driving of the developing agent feeder is stopped.

The amount of the toner in the toner container bottle is also reduced during repeated supply of the toner. When the toner container bottle is substantially emptied, a message for replacement of the toner feeder is displayed on an operation panel of the image forming apparatus or the like to prompt a user to replace the toner feeder.

In order to prevent residual toner from leaking from the toner outlet port in the replacement of the toner feeder, the toner feeder generally has a shutter of a certain configuration provided on the toner outlet port.

The rotational position of the toner container bottle at which the toner container bottle is stopped after having been rotated by the driving of the toner feeder is not particularly defined. Therefore, the toner container bottle is often stopped with its toner outlet port oriented downward with respect to a gravity direction.

In this case, a pressure is exerted on toner present around the shutter, so that the toner is liable to be partly agglomerated. The agglomeration of the toner causes an excess load when the toner feeder is actuated, and results in poor toner supply and malfunction of the shutter.

If the shutter malfunctions, the toner leaks from the toner output port during demounting and mounting of the toner feeder, so that not only the inside of the image forming apparatus but also user's hands and the installation site of the image forming apparatus are contaminated with the toner.

The demounting and mounting of the toner feeder is required not only when the toner container bottle is emptied but also when a trouble such as a paper jam occurs. In this case, a great amount of toner remains in the toner container bottle, so that the malfunction of the shutter inevitably results in severe contamination.

The toner feeder disclosed in the aforesaid patent publication is capable of reading information on the bar code attached to the peripheral surface of the toner container bottle by the optical sensor to detect the specifications of the toner container bottle, particularly, to determine whether or not the toner container bottle is a genuine product. However, the toner feeder is incapable of stopping the toner outlet port at a specific rotational position.

It is also conceivable to detect timing at which the bar code passes by the optical sensor for stopping the toner outlet port at a specific rotational position at which no load is exerted on the shutter. However, the optical sensor is susceptible to contamination with scattered toner. If the bar code and the optical sensor are contaminated with the scattered toner, malfunction will occur.

It is also conceivable to provide cleaners for removing the scattered toner from the bar code and the optical sensor. However, the construction of the toner feeder is complicated, thereby resulting in poor reliability and cost increase.

SUMMARY OF THE INVENTION

In view of the foregoing, it is an object of the present invention to provide a toner feeder which has a simple construction and is capable of assuredly stopping its toner outlet port at a specific rotational position and preventing leak of toner which may otherwise occur during demounting and mounting of the toner feeder.

According to the present invention, there is provided a toner feeder which is removably mounted in an image forming apparatus including a rotation driver for rotating a toner container and a rotation controller for controlling the rotation driver, and comprises a toner container for containing toner, and a support holder which holds the toner container in an axially rotatable manner, the toner container having a toner outlet port and a magnetic member provided on an outer peripheral surface thereof, the support holder including magnetism detection means which detects passage of the magnetic member and outputs a detection signal to the rotation controller, wherein the rotation controller controls the rotation driver so as to stop the toner container with the toner outlet port oriented upward with respect to a gravity direction on the basis of the output of the magnetism detection means after the toner container is rotated by the rotation driver to feed out a predetermined amount of toner from the toner outlet port.

According to the present invention, the rotation controller controls the rotation driver on the basis of the output of the magnetism detection means. Therefore, the toner outlet port can be assuredly stopped at a rotational position at which the toner outlet port is oriented upward with respect to the gravity direction regardless of contamination with scattered toner. Thus, leak of the toner can be prevented which may otherwise occur during demounting and mounting of the toner feeder.

DESCRIPTION OF THE PREFERRED EMBODIMENTS

Figure 1:
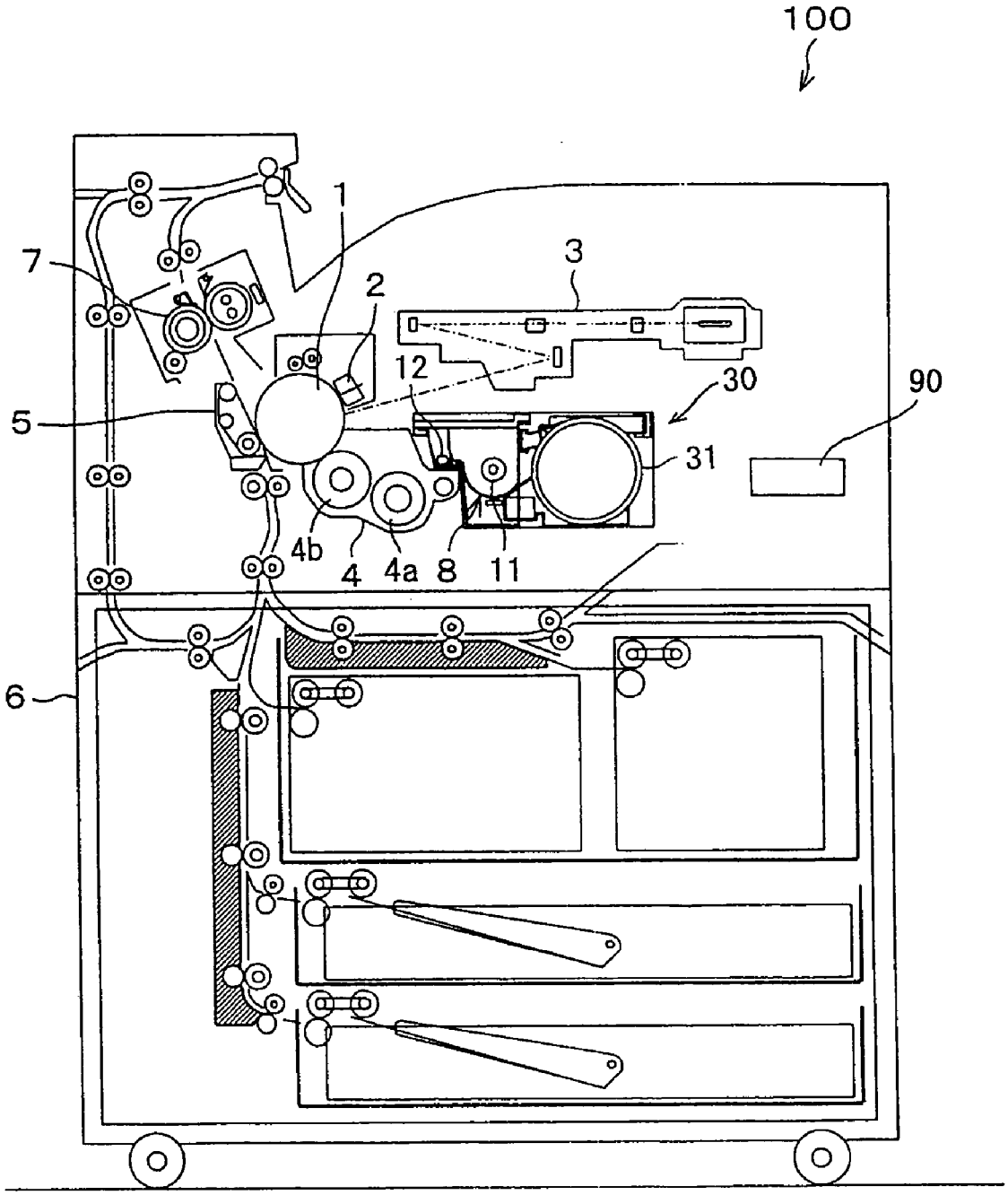
FIG. 1 is an explanatory diagram schematically illustrating the construction of a copying machine in which a toner feeder according to an embodiment of the present invention is mounted.

A toner feeder according to the present invention is removably mounted in an image forming apparatus including a rotation driver for rotating a toner container and a rotation controller for controlling the rotation driver. The toner feeder comprises a toner container for containing toner, and a support holder which holds the toner container in an axially rotatable manner. The toner container has a toner outlet port and a magnetic member provided on an outer peripheral surface thereof. The support holder includes magnetism detection means which detects passage of the magnetic member and outputs a detection signal to the rotation controller. The rotation controller controls the rotation driver so as to stop the toner container with the toner outlet port oriented upward with respect to a gravity direction on the basis of the output of the magnetism detection means after the toner container is rotated by the rotation driver to feed out a predetermined amount of toner from the toner outlet port.

In the present invention, the type of the image forming apparatus to be used with the toner feeder is not particularly limited, as long as the image forming apparatus is capable of forming an image by using toner. Examples of the image forming apparatus include copying machines and facsimile machines of an electrophotographic system.

The construction of the rotation driver is not particularly limited, as long as the rotation driver is capable of rotatively driving the toner container. For example, the rotation driver includes an electric motor, reduction gears and a driving shaft.

The construction of the rotation controller is not particularly limited, as long as the rotation controller is capable of controlling the rotation driver on the basis of the output of the magnetism detection means. For example, the rotation controller includes an I/O port which receives the output of the magnetism detection means, a CPU, a ROM which stores a control program, a RAM which stores various setting conditions, and a driver circuit which applies a voltage to the rotation driver on the basis of an output of the CPU.

The shape and structure of the toner container are not particularly limited, as long as the toner container has a toner outlet port and is axially rotatable.

The construction of the support holder is not particularly limited, as long as the support holder is capable of holding the toner container in an axially rotatable manner.

The type and structure of the magnetic member are not particularly limited, as long as the magnetic member is capable of generating a magnetic field.

In the present invention, the expression "to stop the toner container with the toner outlet port oriented upward with respect to the gravity direction" means that the toner container is stopped at a rotational position at which the weight of the toner is not exerted on the toner outlet port.

In the inventive toner feeder, the magnetism detection means may be a reed switch, a Hall element or a magnetoresistance element. With this arrangement, the magnetism detection means can be provided as having high reliability with a simple construction.

In the inventive toner feeder, the support holder may include a toner transport path communicating with the toner outlet port and a shutter provided at an end of the toner transport path. With this arrangement, the shutter provided at the end of the toner transport path assuredly prevents the leak of the toner which may otherwise occur during the demounting and mounting of the toner feeder.

In the present invention, as described above, the rotation controller controls the rotation driver so as to stop the toner outlet port at the rotational position at which the toner output port is oriented upward with respect to the gravity direction. This prevents partial agglomeration of the toner which may otherwise occur when a pressure is exerted on toner present around the toner outlet port. Therefore, various adverse effects such as an excess load at actuation of the toner feeder, a toner supply failure and malfunction of the shutter can be prevented which may otherwise occur due to the agglomeration of the toner.

Since the malfunction of the shutter is prevented as described above, the leak of the toner which may otherwise occur during the demounting and mounting of the toner feeder can be assuredly prevented as primarily intended by the present invention.

In the inventive toner feeder, the magnetic member may include a plurality of magnetic members arranged in spaced relation, and the rotation controller may be adapted to detect specifications of the toner feeder on the basis of time intervals of the passage of the magnetic members. With this arrangement, the specifications of the toner feeder are detected on the basis of the time intervals of the passage of the magnetic members, so that the detection of the specifications of the toner feeder can be assuredly achieved regardless of the contamination with the toner. The specifications of the toner feeder herein means information including, for example, whether or not the toner feeder is a genuine product, the destination of the toner, the volume of the toner container and the color of the toner.

If it is determined that the toner feeder is not genuine as a result of the detection of the specifications of the toner feeder, for example, a message for prompting a user to replace the toner feeder with a genuine product is displayed on a control panel, thereby preventing disorder and malfunction of the image forming apparatus.

In the inventive toner feeder, the magnetism detection means may include a connector, and the support holder may have a hollow cylindrical wall for supporting a part of the toner container provided with the magnetic member in an axially rotatable manner. The magnetism detection means may be spaced from the toner container with the intervention of the wall, and electrically connected to the rotation controller of the image forming apparatus via the connector. This arrangement prevents the connector from being contaminated with scattered toner, thereby ensuring the reliability of the electrical connection to the rotation controller. With this arrangement, the magnetism detection means detects the passage of the magnetic member through the wall of the support holder. The detection is based on magnetism but not on light, so that the wall does not hinder the function of the magnetism detection means.

In the inventive toner feeder, the toner container may be composed of a soft resilient resin, and the magnetic member may be a flexible rubber magnet.

In general, the toner container is produced by blow-molding a soft resilient resin such as polyacetal or polyethylene from the viewpoint of shock resistance. However, if a rigid magnet such as a sintered ferrite magnet is bonded to the toner container, an adhesive surface of the magnet cannot follow deformation and warp of the toner container, resulting in separation of the magnet. However, where the flexible rubber magnet is used as the magnetic member, separation of the magnetic member can be prevented because an adhesive surface of the magnetic member can follow the deformation and warp of the container.

With reference to the attached drawings, the present invention will hereinafter be described in detail by way of an embodiment thereof.

A toner feeder according to the embodiment of the present invention will be described based on FIGS. 1 to 14.

Figure 2:
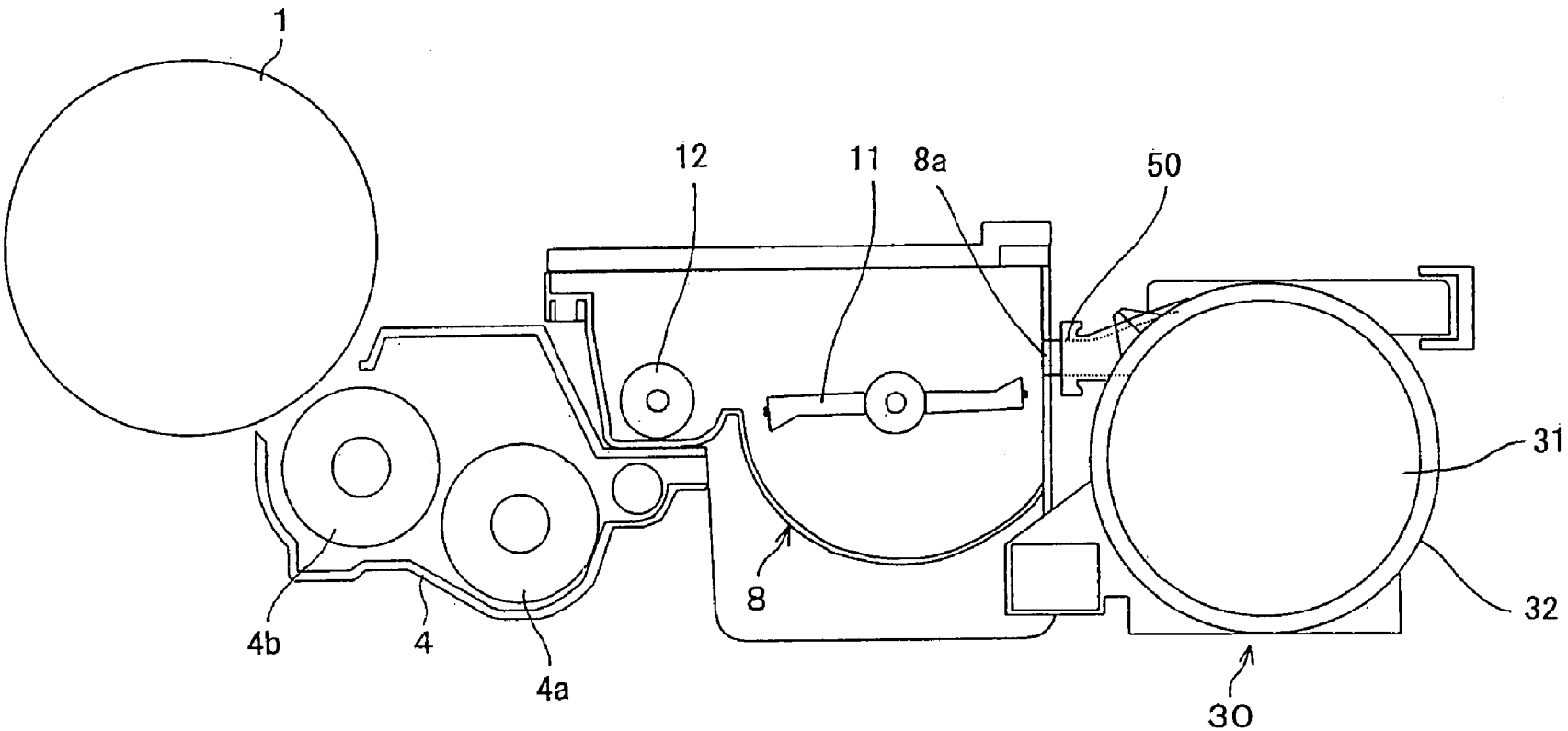
FIG. 2 is an enlarged diagram of major portions of the copying machine shown in FIG. 1.
Figure 3:
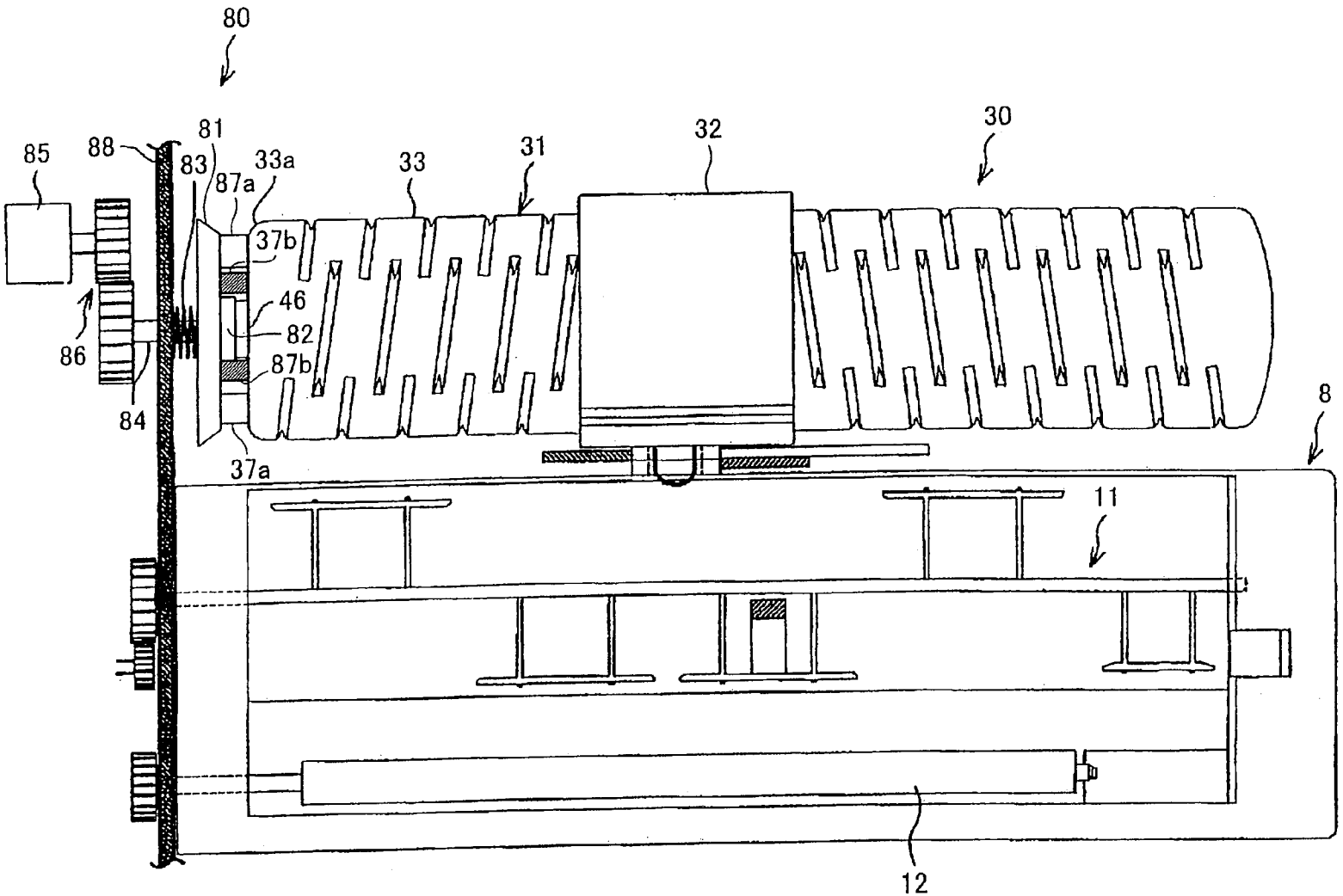
FIG. 3 is an explanatory diagram of the toner feeder according to the embodiment of the present invention and a toner hopper shown in FIG. 2 as seen from the top.
Figure 4:
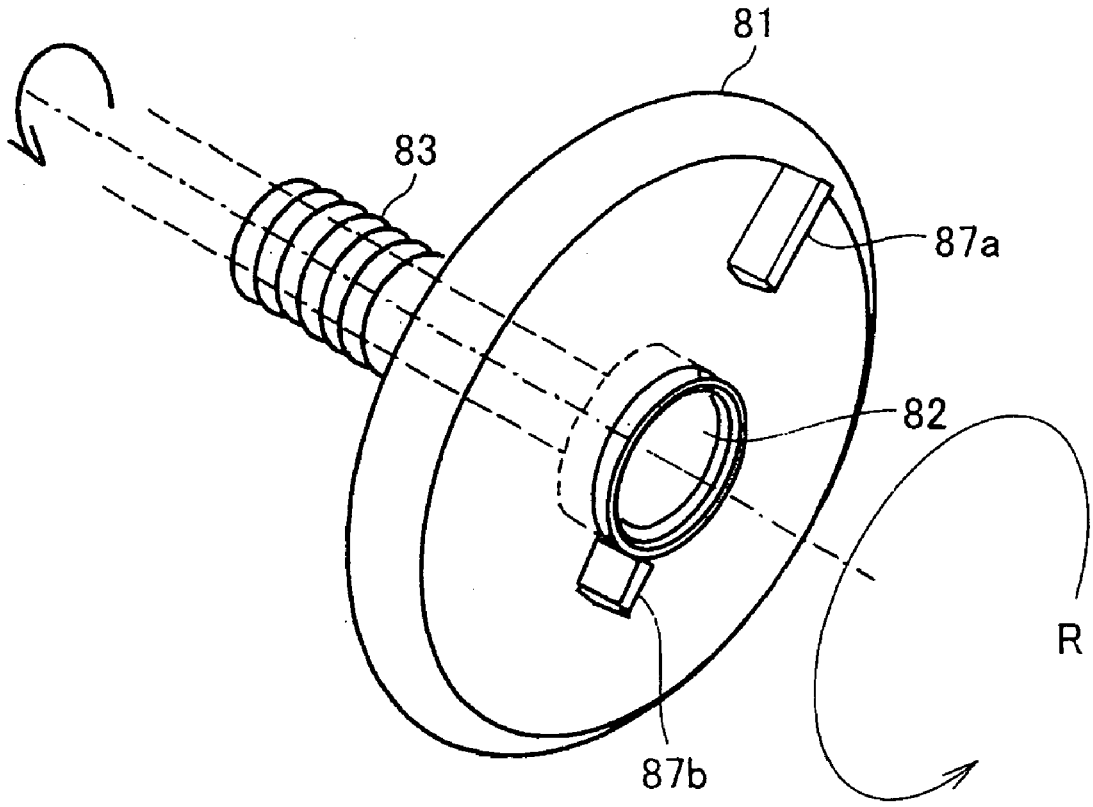
FIG. 4 is a perspective view of a driving plate shown in FIG. 3.
Figure 5:
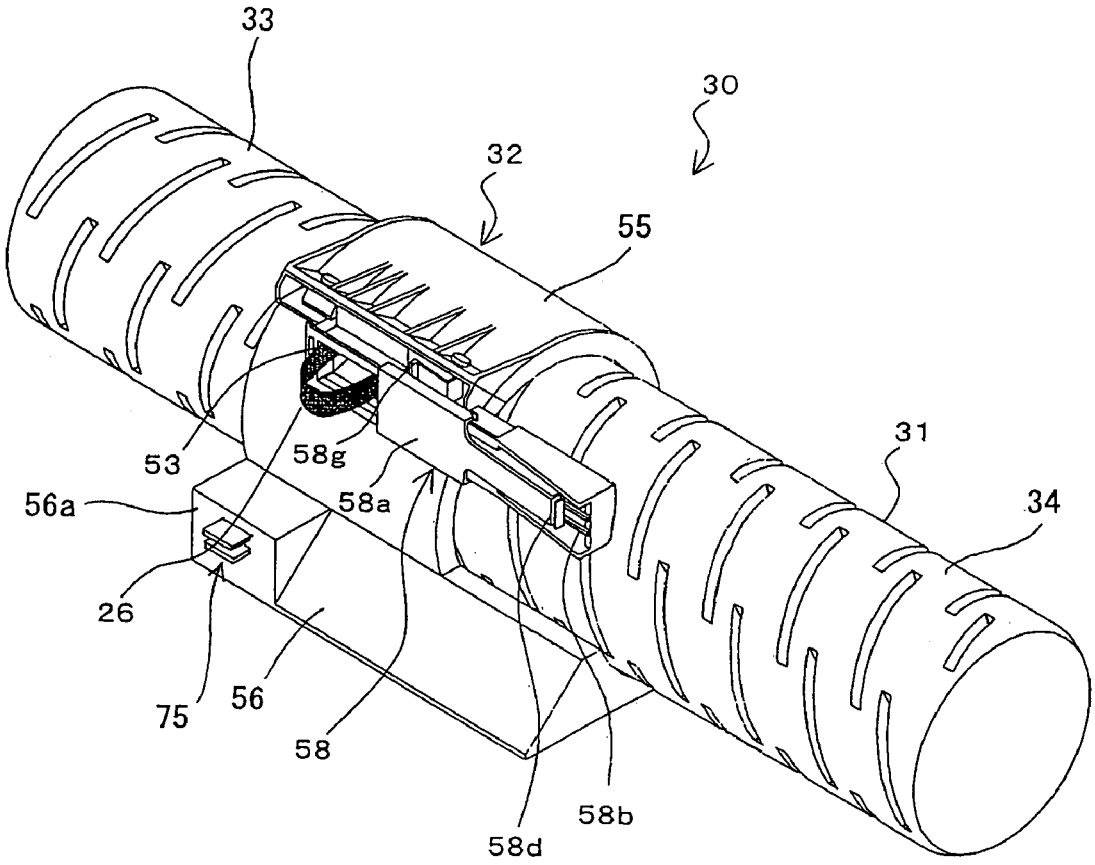
FIG. 5 is a perspective view of the toner feeder according to the embodiment of the present invention.
Figure 6:
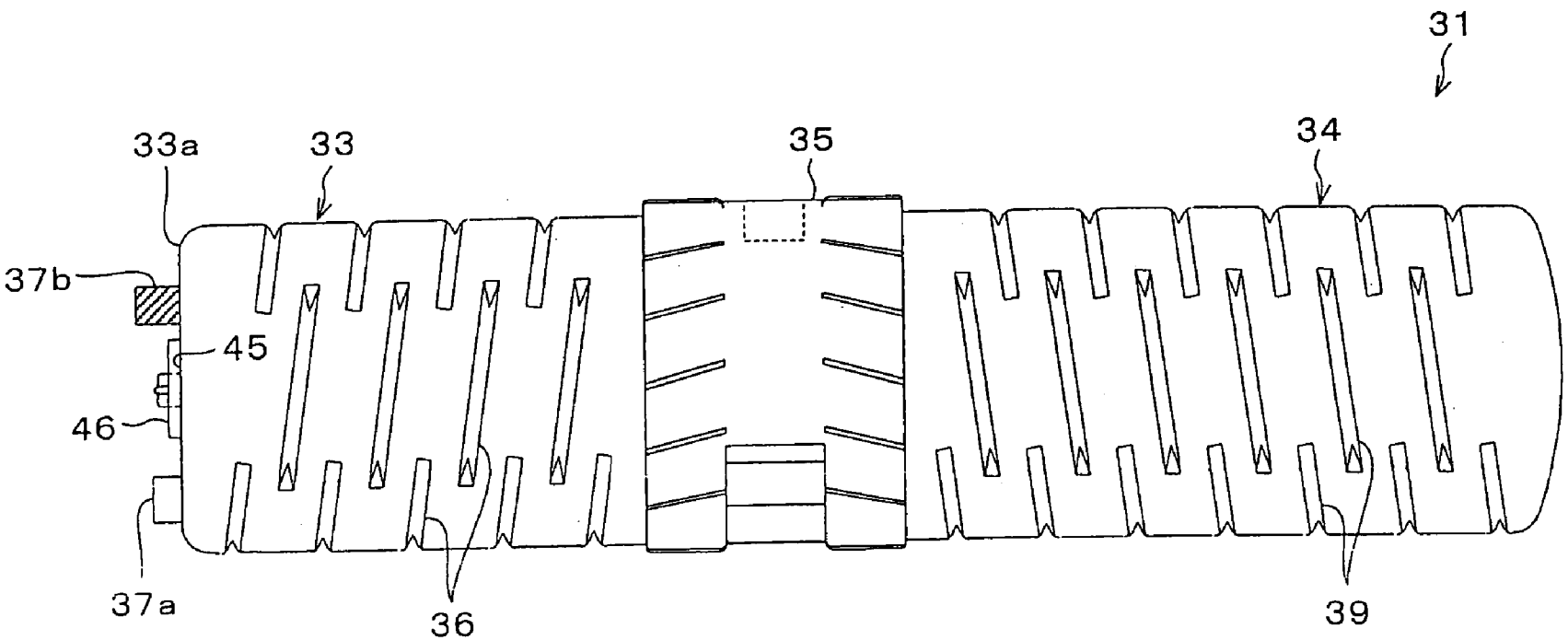
FIG. 6 is a plan view of a toner container bottle shown in FIG. 5.
Figure 7:
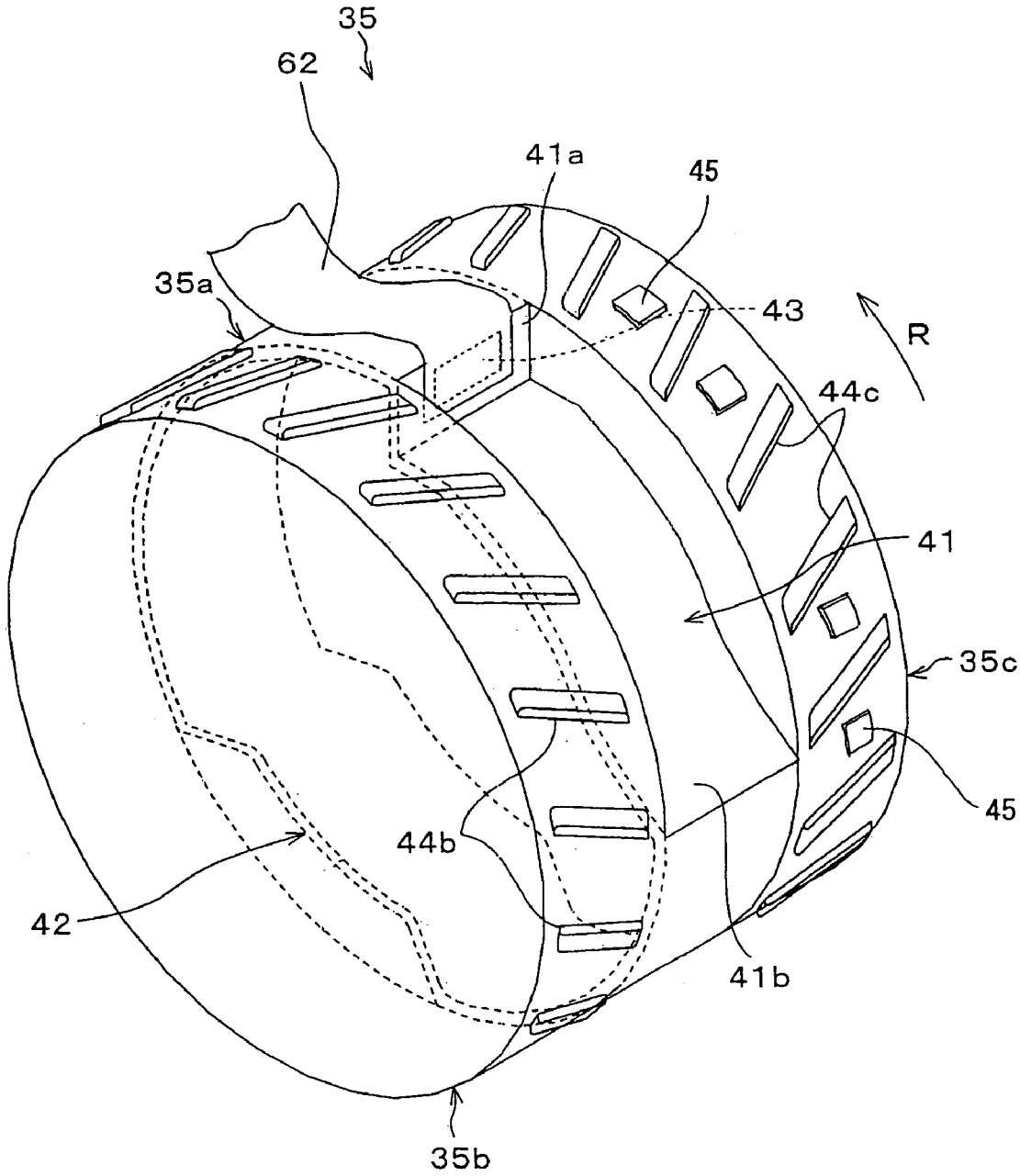
FIG. 7 is a partial enlarged perspective view illustrating only a third container portion of the toner container bottle shown in FIG. 6.
Figure 8:
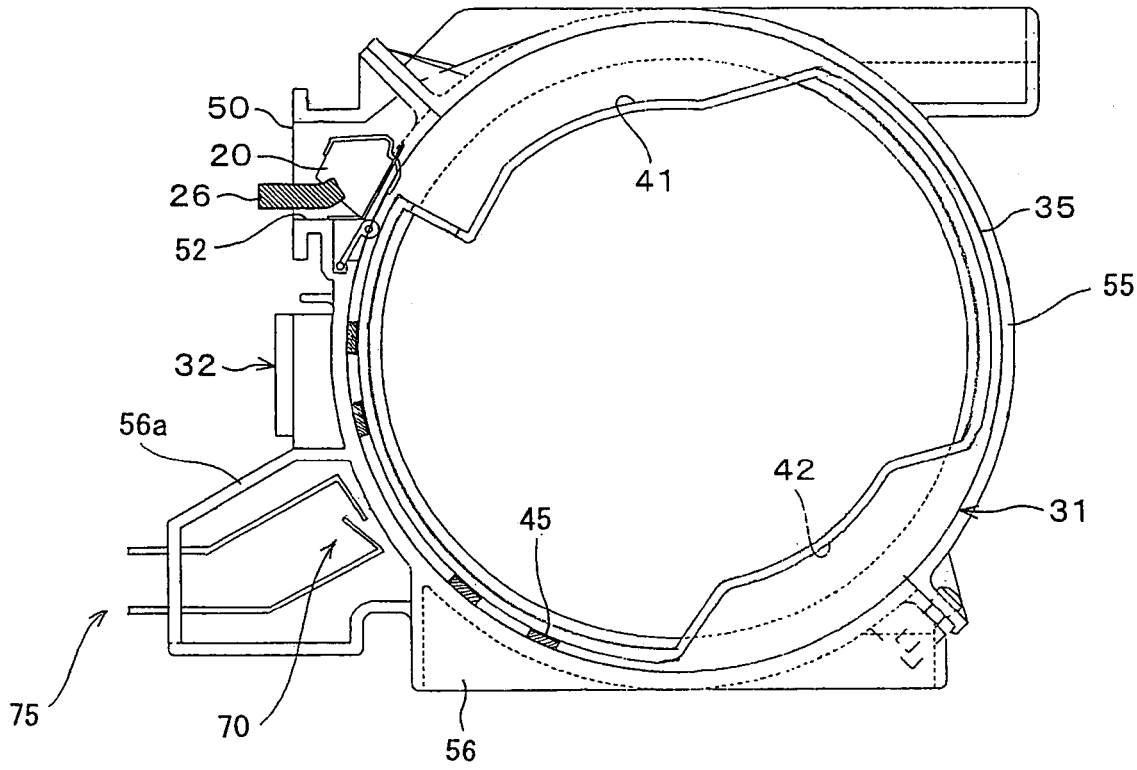
FIG. 8 is a sectional view of the toner feeder shown in FIG. 5.
Figure 9:
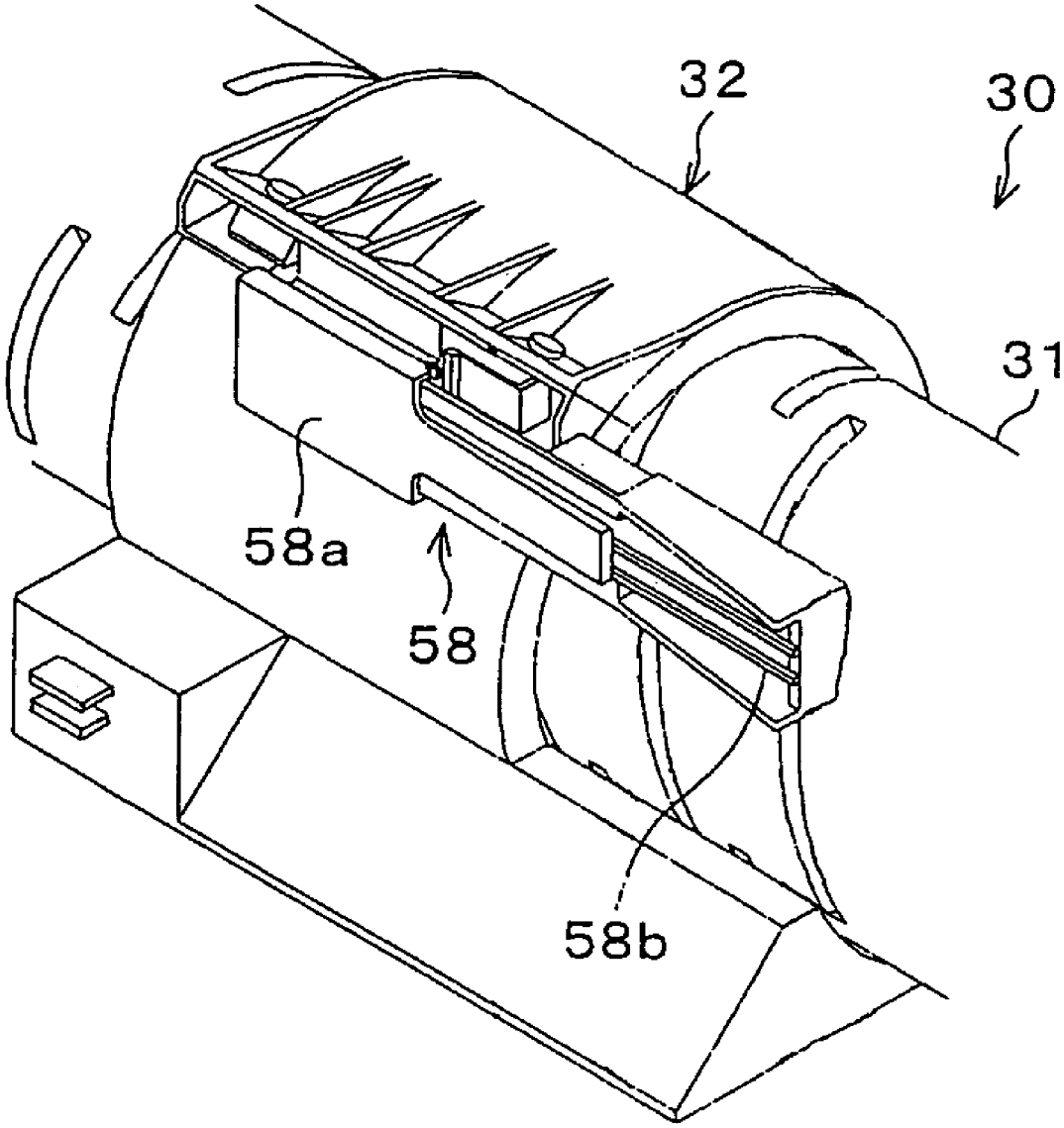
FIG. 9 is a partial perspective view illustrating the toner feeder shown in FIG. 5 with its toner supply port being closed by a shutter.
Figure 10:
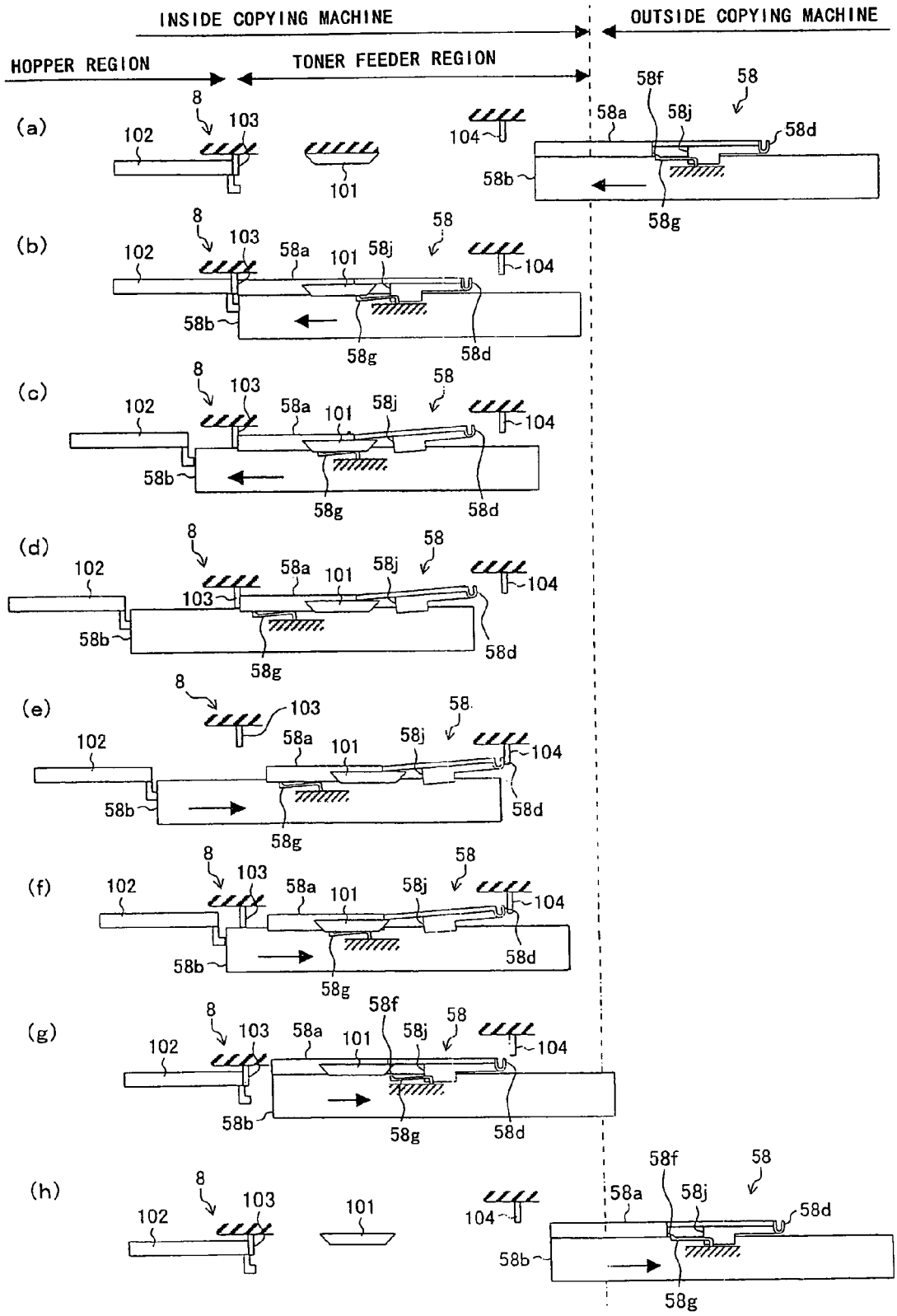
FIGS. 10(*a*) to 10(*h*) are explanatory diagrams illustrating opening and closing of the shutter shown in FIG. 9.
Figure 11:
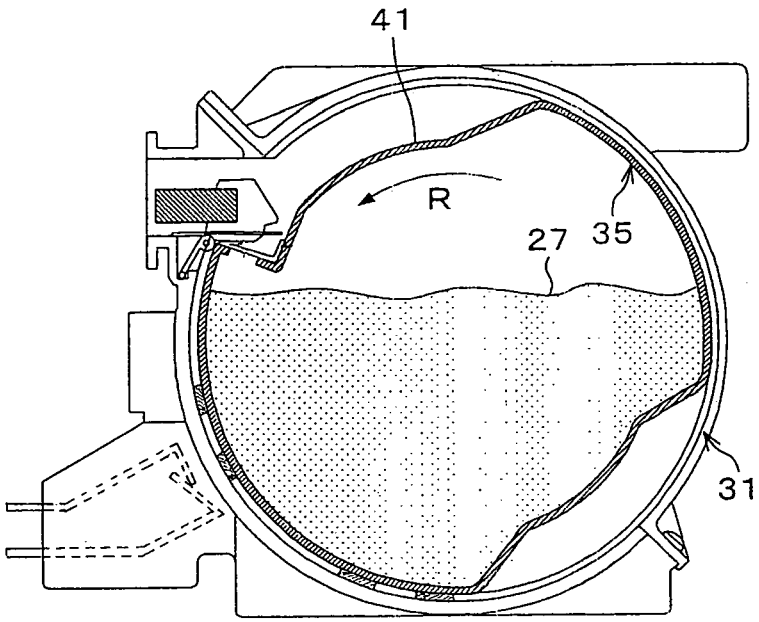
FIGS. 11(*a*) and 11(*b*) are explanatory diagrams illustrating the state of the toner container bottle shown in FIG. 5 rotated for toner supply.
Figure 11:
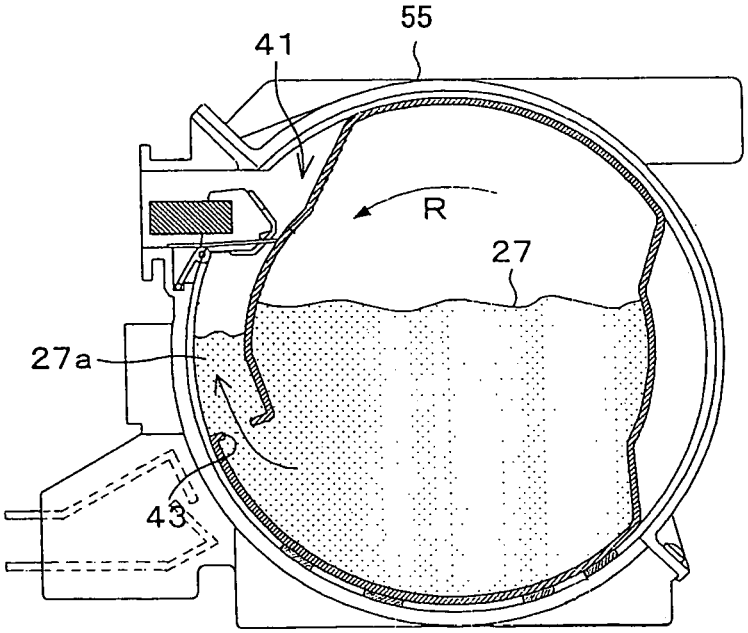
Figure 13:
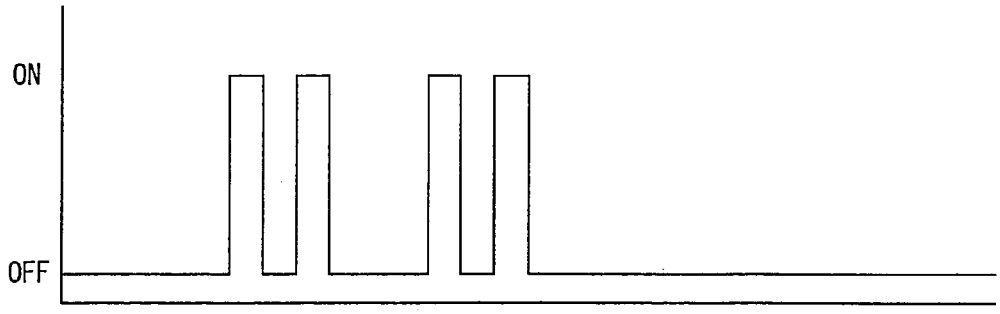
FIG. 13 is an explanatory diagram illustrating a signal waveform detected by a reed switch when a magnetic member passes by the reed switch during rotation of the toner container bottle shown in FIGS. 11 and 12.
Figure 14:
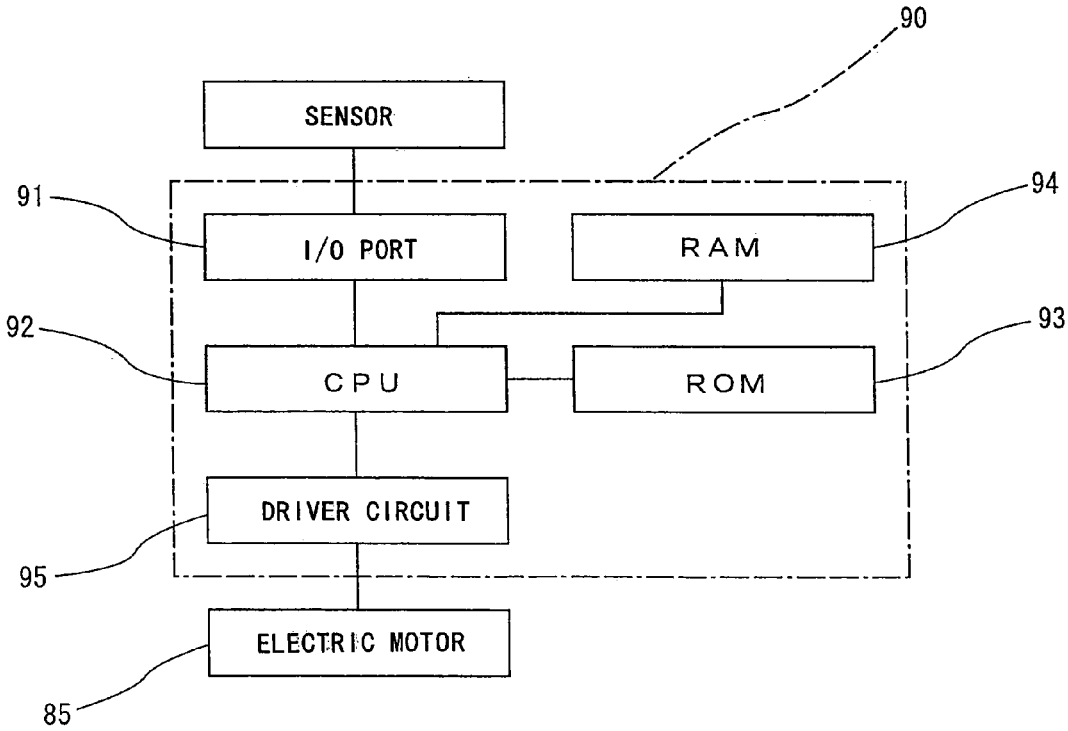
FIG. 14 is a block diagram schematically illustrating the construction of a rotation controller shown in FIG. 1.

FIG. 1 is an explanatory diagram schematically illustrating the construction of a copying machine in which the toner feeder of this embodiment is mounted. FIG. 2 is an enlarged diagram of major portions of the copying machine shown in FIG. 1. FIG. 3 is an explanatory diagram of the toner feeder and a toner hopper as seen from the top. FIG. 4 is a perspective view of a driving plate shown in FIG. 3. FIG. 5 is a perspective view of the toner feeder. FIG. 6 is a plan view of a toner container bottle. FIG. 7 is a partial enlarged perspective view illustrating only a third container portion of the toner container bottle shown in FIG. 6. FIG. 8 is a sectional view of the toner feeder shown in FIG. 5. FIG. 9 is a partial perspective view illustrating the toner feeder shown in FIG. 5 with its toner supply port being closed by a shutter. FIGS. 10(*a*) to 10(*h*) are explanatory diagrams illustrating opening and closing of the shutter. FIGS. 11(*a*), 11(*b*), 12(*c*) and 12(*d*) are explanatory diagrams illustrating the state of the toner container bottle rotated for toner supply. FIG. 13 is an explanatory diagram illustrating a signal waveform detected by a reed switch when a magnetic member passes by the reed switch during rotation of the toner container bottle. FIG. 14 is a block diagram schematically illustrating the construction of a rotation controller.

As shown in FIG. 1, the toner feeder (toner cartridge) 30 of this embodiment is removably mounted in a copying machine (image forming apparatus) 100 which includes a rotation driver 80 (see FIG. 3) for rotating a toner container bottle (toner container) 31 and a rotation controller 90 for controlling the rotation driver 80. The copying machine 100 includes a toner hopper 8, a developing device 4, a photosensitive drum 1, a charging device 2, a laser exposure device 3, a transfer device 5, a sheet feeder 6 and a fixing device 7 in addition to the rotation driver 80, the rotation controller 90 and the toner feeder 30.

The copying machine 100 is adapted to electrically charge the photosensitive drum 1 as an electrostatic latent image carrier by the charging device 2 and then form an electrostatic latent image on a surface of the photosensitive drum 1 by the laser exposure device 3.

In the developing device 4, toner supplied from the toner feeder 30 through the toner hopper 8 is mixed with a carrier of iron powder with stirring by a stirring roller 4*a* to provide a two-component developing agent, which is in turn carried on a surface of a developer roller 4*b* having a plurality of magnetic fields to form a so-called magnetic brush.

When the magnetic brush formed on the surface of the developer roller 4*b* is brought into opposed relation to the photosensitive drum 1, negatively charged toner is transferred onto the photosensitive drum 1 to develop the electrostatic latent image into a toner image on the photosensitive drum 1. The toner image on the surface of the photosensitive drum 1 is transferred onto a paper sheet fed from the sheet feeder 6 by the transfer device 5. The toner image transferred onto the paper sheet is thermally fixed on the paper sheet in the fixing device 7, and the paper sheet is outputted to the outside.

As shown in FIG. 2, a concentration sensor (not shown) for measuring the toner concentration of the developing agent is provided in the developing device 4. If the toner concentration is reduced to less than a predetermined concentration level, a stirring member 11 of the toner hopper 8 is driven to stir the toner for easy mixing of the toner with the developing agent and supply the toner into the developing device 4 via a feed roller 12.

A sensor (not shown) for measuring the amount of the toner in the toner hopper 8 is provided in the toner hopper 8. If the amount of the toner in the toner hopper 8 is reduced to less than a predetermined level, the rotation controller 90 (see FIG. 1) drives the rotation driver 80 (see FIG. 3) to supply the toner into the toner hopper 8 from the toner feeder 30. Thus, the toner concentration of the developing agent in the developing device 4 is constantly maintained within a predetermined range.

Next, the toner feeder 30 will be explained in greater detail. As shown in FIG. 5, the toner feeder 30 includes a hollow cylindrical toner container bottle 31 which contains toner, and a support holder 32 which holds the toner container bottle 31 in an axially rotatable manner.

As shown in FIG. 6, the toner container bottle 31 includes a first container portion 33 and a second container portion 34 having the same outer diameter, and a third container portion 35 having a greater outer diameter than the first and second container portions 33, 34 and disposed between the first and second container portions 33 and 34.

As shown in FIG. 3, the first container portion 33 has two projections 37*a*, 37*b* provided on an end face 33*a* thereof for engagement with two engagement pieces 87*a*, 87*b* of a driving plate 81 of the rotation driver 80.

As shown in FIGS. 3 and 6, the end face 33*a* has a toner charging port 47 provided at the center thereof for recharging toner into a toner container bottle recycled after use, and the toner charging port 47 is closed by a supply cap 46. As shown in FIG. 4, the driving plate 81 has a hole 82 formed at the center thereof for receiving the supply cap 46.

As shown in FIGS. 3 and 4, the driving plate 81 is attached to one end of a rotation shaft 84 which extends through a housing 88. A coil spring 83 for biasing the driving plate 81 toward the end face 33*a* of the toner container bottle 31 is provided between the housing 88 and the driving plate 81. As shown in FIG. 3, an electric motor 85 as a driving source is connected to the other end of the rotation shaft 84 via a plurality of reduction gears 86.

As shown in FIG. 6, the first container portion 33 and the second container portion 34 respectively have transport ribs 36 and 39 provided on inner peripheral surfaces thereof as projecting helically at a predetermined inclination angle for transporting toner contained in the first and second container portions 33, 34 to the third container portion 35 during rotation of the toner container bottle 31.

As shown in FIG. 7, the third container portion 35 has an outlet path provision region 35*a* in which a toner outlet path 41 is provided, and guide piece provision regions 35*b*, 35*c* in which guide pieces 44*b*, 44*c* are provided on opposite sides of the outlet path provision region 35*a*.

The toner outlet path 41 is provided in the outlet path provision region 35*a* in a recess formed in an outer peripheral surface portion of the third container portion 35. One end of the toner outlet path 41 is connected to the outer peripheral surface of the third container portion 35 via a steep step portion 41*a*. A toner outlet port 43 is provided in the step portion 41*a* by utilizing a level different of the step portion 41*a*. The other end of the toner outlet path 41 is connected to the outer peripheral surface of the third container portion 35 via a gently raised portion 41*b*.

The third container portion 35 further has a recessed portion 42 provided on a side opposite from the toner outlet path 41 as projecting inward thereof for raising the toner in the third container portion 35 to promote discharge of the toner from the toner outlet port 43.

Before use of the toner feeder 30, the toner outlet port 43 is sealed with a seal 62. The seal 62 is automatically removed when the toner container bottle 31 is first rotated after the toner feeder 30 is mounted in the copying machine 100.

The guide pieces 44*b* and 44*c* are provided on outer peripheral surface portions in the guide piece provision regions 35*b* and 35*c* as projecting outward so that toner leaking from the toner outlet path 41 to the guide piece provision regions 35*b*, 35*c* is guided into the toner outlet path 41 or the recessed portion 42.

Magnetic members 45 prepared by stamping a rubber magnet sheet (BQK12 available from TDK) are bonded onto the outer peripheral surface portion in the guide piece provision region 35*c* outside the guide pieces 44*c* as arranged at predetermined intervals.

As shown in FIGS. 5 and 8, the support holder 32 which holds the toner container bottle 31 in an axially rotatable manner includes a hollow cylindrical support portion 55 which supports the toner container bottle 31 in an axially rotatable manner, and a base 56 which supports the support portion 55. The support portion 55 covers the third container portion 35 (see FIG. 6), and supports portions of the toner container bottle 31 adjacent to boundaries between the first container portion 33 and the third container portion 35 and between the second container portion 34 and the third container portion 35 via sealing members (not shown) having a V-shape in section. The base 56 has a mount guide portion 56*a*. A reed switch 70 which is turned on by passage of the magnetic members 45 and a connector 75 which electrically connects the reed switch 70 to the rotation controller 90 of the copying machine 100 with the toner feeder 30 mounted in the copying machine 100 are housed in the mount guide portion 56*a*.

The support portion 55 has a toner transport path 52 which is intermittently connected to the toner outlet path 41 of the third container portion 35 via a scraper 20 during the rotation of the toner container bottle 31. A shutter 58 is provided at an end of the toner transport path 52, i.e., at a toner supply port 50.

The shutter 58 is opened as shown in FIG. 5 only when the toner feeder 30 is mounted in the copying machine 100, whereby the toner supply port 50 of the support holder 32 communicates with a toner inlet port 8*a* of the toner hopper 8 as shown in FIG. 2. On the other hand, when the toner feeder 30 is demounted from the copying machine 100, the shutter 58 is closed as shown in FIG. 9 to prevent the leak of the toner.

More specifically, as shown in FIG. 10(*a*), a shutter plate 58*a* of the shutter 58 is closed before the toner feeder 30 is mounted in the copying machine 100. In this state, a lock claw 58*f* provided on the shutter plate 58*a* is in engagement with a stopper 58*g* provided on a shutter plate guide portion 58*b*. That is, the stopper 58*g* prevents the shutter plate 58*a* from being needlessly opened.

As shown in FIG. 10(*b*), the toner feeder 30 is inserted into the copying machine 100 parallel to a longitudinal axis of the toner container bottle 31 from the outside of the copying machine. 100 thereby to be mounted in the copying machine 100. At this time, a rib 101 fixed to the toner hopper 8 depresses the stopper 58*g* toward the toner container bottle 31. Thus, the lock claw 58*f* is disengaged from the stopper 58*g*, thereby making the shutter plate 58*a* movable.

When the toner feeder 30 reaches a hopper region in the copying machine 100 as shown in FIG. 10(*c*), an end of a hopper shutter 102 of the toner hopper 8 abuts against the shutter 58 with an opening claw 103 of the toner hopper 8 in contact with the shutter plate 58*a*.

When the toner feeder 30 is further moved into the hopper region, the hopper shutter 102 is pushed by the toner feeder 30. Thus, the toner inlet port 8*a* of the toner hopper 8 is opened, and the shutter plate 58*a* is opened.

When the hopper shutter 102 and the shutter plate 58*a* are thereafter completely opened as shown in FIG. 10(*d*), the toner feeder 30 abuts against a stopper (not shown) provided in the copying machine 100, whereby further movement of the toner feeder 30 is restricted. In this state, the toner supply port 50 of the toner feeder 30 and the toner inlet port 8*a* of the toner hopper 8 are opposed to each other for communication therebetween.

On the other hand, when the toner feeder 30 is demounted from the copying machine 100, as shown in FIG. 10(*e*), the hopper shutter 102 follows the movement of the toner feeder 30 by a biasing force of a spring not shown, whereby the toner inlet port 8*a* of the toner hopper 8 is closed.

When the toner feeder 30 is further moved, a resilient end portion 58*d* provided at an end of the shutter plate 58*a* is brought into abutment against a closing claw 104 provided on the toner hopper 8 as shown in FIG. 10(*f*), whereby the shutter plate 58*a* is pushed by the closing claw 104 to be moved relative to the shutter plate guide 58*b*.

When the toner supply port 50 is thereafter completely closed by the shutter plate 58*a* as shown in FIG. 10(*g*), the shutter plate 58*a* abuts against a stopper (not shown) of the shutter 58, whereby further movement of the shutter plate 58*a* is restricted.

When the toner feeder 30 is thereafter further moved, the stopper 58*g* which has been depressed toward the toner container bottle 31 by the rib 101 is moved back into its original position by its resilience as shown in FIG. 10(*h*), whereby the lock claw 58*f* is brought into engagement with the stopper 58*g* with the resilient end portion 58*d* fitted in a notch of the shutter plate guide 58*b*.

In this manner, the shutter 58 of the toner feeder 30 is automatically opened when being mounted in the copying machine 100, and is automatically closed when being demounted from the copying machine 100.

With the toner feeder 30 mounted in the copying machine 100, the toner supply port 50 of the toner feeder 30 communicates with the toner inlet port 8*a* of the toner hopper 8 as shown in FIG. 2. When the amount of the toner in the toner hopper 8 is reduced to less than the predetermined level in this state, the sensor detects the reduction of the toner amount and outputs a signal to the rotation controller 90. In response to the signal, the rotation controller 90 drives the rotation driver 80 to rotate the toner container bottle 31 of the toner feeder 30 for supplying the toner into the toner hopper 8.

When the toner container bottle 31 is rotated, as shown in FIGS. 11(*a*) and 11(*b*), toner 27 is discharged from the toner outlet port 43, and the discharged toner 27*a* is charged in a space defined between the toner outlet path 41 and an inner peripheral surface of the support portion 55.

Figure 12:
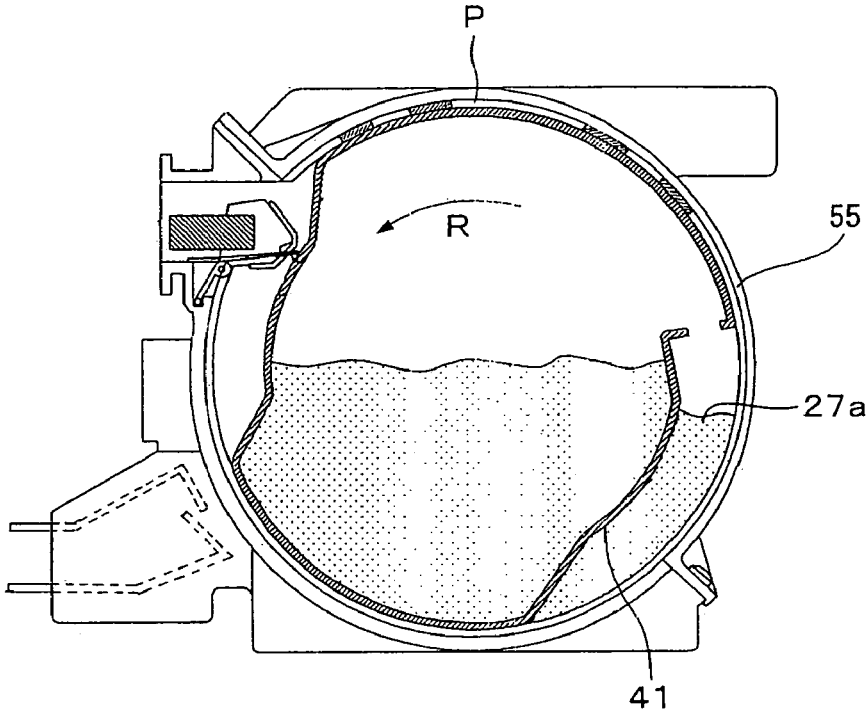
FIGS. 12(*c*) and 12(*d*) are explanatory diagrams illustrating the state of the toner container bottle shown in FIG. 5 rotated for toner supply.
Figure 12:
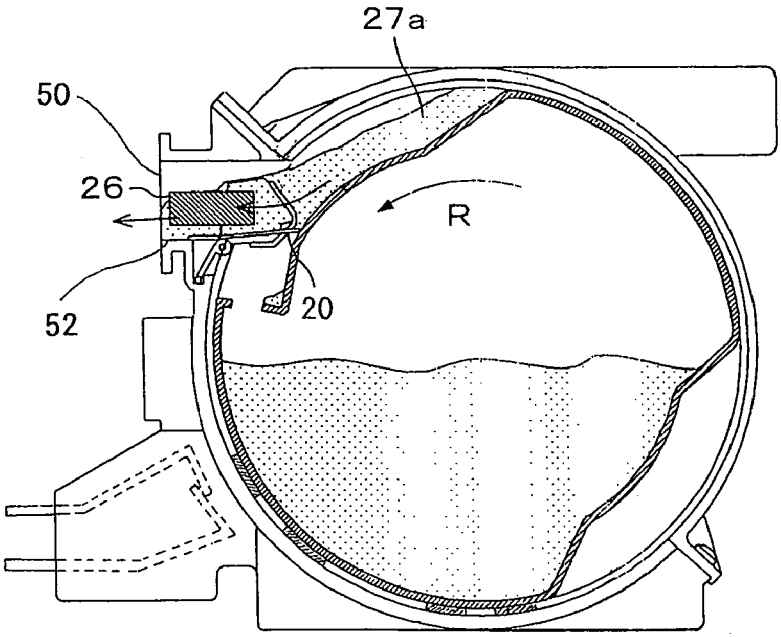

The toner 27*a* charged in the space defined between the toner outlet path 41 and the inner peripheral surface of the support portion 55 is transported along the inner peripheral surface of the support portion 55 as shown in FIG. 12(*c*), and guided onto the toner transport path 52 by the scraper 20 provided at the end of the toner transport path 52 of the support portion 55 in sliding contact with the outer peripheral surface of the toner container bottle 31 as shown in FIG. 12(*d*). Then, the toner 27*a* is supplied into the toner inlet port 8*a* (see FIG. 2) of the toner hopper 8 through the toner supply port 50.

A blocking prevention member 26 which follows the movement of the scraper 20 for forcibly scraping the toner on the toner transport path 52 is provided on the toner transport path 52. Thus, the toner is prevented from remaining and agglomerating on the toner transport path 52.

When the toner container bottle 31 is rotatively driven as described above, the magnetic members 45 bonded onto the outer peripheral surface of the guide piece provision region 35*c* are intermittently brought into opposed relation to the reed switch 70 housed in the mount guide portion 56*a* of the support holder 32. The reed switch 70 is turned on when it is opposed to each of the magnetic members 45, and turned off when it is not opposed to any of the magnetic members 45. Therefore, a signal according to the intervals of the magnetic members 45 as shown in FIG. 13 is inputted to the rotation controller 90 every time the toner container bottle 31 makes one turn.

As shown in FIG. 14, the rotation controller 90 mainly includes an I/O port 91 to which the signal of the reed switch 70 is inputted, a CPU 92, a ROM 93 which stores a control program for the CPU 92, a RAM 94 which stores setting conditions, and a driver circuit 95 which applies a voltage to the electric motor 85 of the rotation driver 80 on the basis of an output of the CPU 92. The rotation controller 90 compares the signal inputted from the reed switch 70 with an on-off waveform preliminarily stored in the RAM 94 to determine whether or not the toner feeder 30 is a genuine product. If it is judged that the toner feeder 30 is not genuine, a message for suggesting use of a genuine toner feeder is displayed on the operation panel of the copying machine 100.

If the toner feeder 30 is genuine, the rotation controller 90 compares the signal inputted from the reed switch 70 with the on-off waveform preliminarily stored in the RAM 94 to detect the rotational position of the toner outlet port 43 of the toner container bottle 31. When a signal indicating that the amount of the toner in the toner hopper 8 reaches the predetermined level is inputted from the sensor, the rotation controller 90 controls the rotation driver 80 to stop the toner outlet port 43 of the toner container bottle 31 at a position P at which the toner outlet port 43 is oriented upward with respect to a gravity direction (see FIG. 12(*c*)).

Thus, the agglomeration of the toner can be prevented which may otherwise occur when a pressure is exerted on toner present around the shutter 58 during the stop of the toner container bottle 31. Thus, the shutter 58 can constantly maintain its normal function.

Further, the toner supply port 50 is automatically closed by the shutter 58 when the toner feeder 30 is demounted from the copying machine 100. Therefore, the leak of the toner can be assuredly prevented which may otherwise occur during the demounting and mounting of the toner feeder 30.

Figure 15:
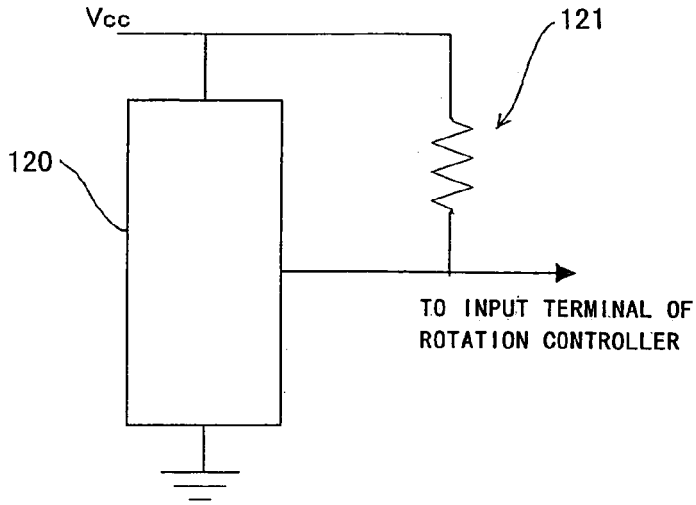
FIG. 15 is an alternative circuit diagram illustrating the construction of a circuit employing a Hall element as a magnetism detection member according to the embodiment of the present invention.
Figure 16:
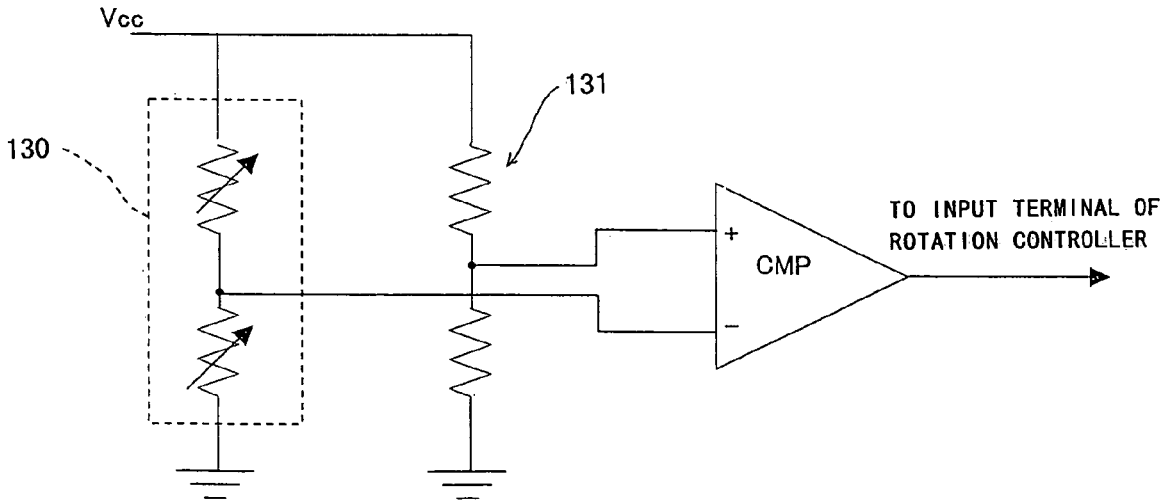
FIG. 16 is an alternative circuit diagram illustrating the construction of a circuit employing a magnetoresistance element as the magnetism detection member according to the embodiment of the present invention.

Although the reed switch 70 is used as the magnetism detection member in this embodiment, a Hall element (Hall IC) 120 which generates a voltage in response to a magnetic field as shown in FIG. 15 or a magnetoresistance element (MR element) 130 whose resistance is varied by a magnetic field as shown in FIG. 16 may be used instead of the reed switch 70. In FIG. 15, a reference numeral 121 denotes a fixed resistor which constitutes a bridge. In FIG. 16, a reference numeral 131 denotes a pull-up resistor of an open collector of the magnetoresistance element 130.

Different numbers of magnetic members 45 having different lengths may be provided at different intervals 45 to specify a greater amount of information including the destination of the toner, the amount of the toner, the color of the toner and the like.

What is claimed is:

1. A toner feeder removably mounted in an image forming apparatus including a rotation driver for rotating a toner container and a rotation controller for controlling the rotation driver, the toner feeder comprising:

a toner container for containing toner;

a support holder which holds the toner container in an axially rotatable manner;

the toner container having a toner outlet port and a magnetic member provided on an outer peripheral surface thereof;

the support holder including magnetism detection means which detects passage of the magnetic member and outputs a detection signal to the rotation controller;

wherein the rotation controller controls the rotation driver so as to stop the toner container with toner outlet port oriented upward with respect to a gravity direction on the basis of the output of the magnetism detection means after the toner container is rotated by the rotation driver to feed out a predetermined amount of toner from the toner outlet port, wherein the magnetic member includes a plurality of magnetic members arranged in spaced relation; and the rotation controller detects specifications of the toner feeder on the basis of time intervals of passage of the magnetic members.

2. A toner feeder removably mounted in an image forming apparatus including a rotation driver for rotating a toner container and a rotation controller for controlling the rotation driver, the toner feeder comprising:

a toner container for containing toner;

a support holder which holds the toner container in an axially rotatable manner;

the toner container having a toner outlet port and a magnetic member provided on an outer peripheral surface thereof;

the support holder including magnetism detection means which detects passage of the magnetic member and outputs a detection signal to the rotation controller;

wherein the rotation controller controls the rotation driver so as to stop the toner container with the toner outlet port oriented upward with respect to a gravity direction on the basis of the output of the magnetism detection means after the toner container is rotated by the rotation driver to feed out predetermined amount of toner from the toner outlet port, wherein the magnetism detection means includes a connector;

the support holder has a hollow cylindrical wall which supports a part of the toner container provided with the magnetic member in an axially rotatable manner; and the magnetism detection means is spaced from the toner container with the intervention of the wall, and electrically connected to the rotation controller of the image forming apparatus via the connector.

3. A toner feeder removably mounted in an image forming apparatus including a rotation driver for rotating a toner container and a rotation controller for controlling the rotation driver, the toner feeder comprising:

a toner container for containing toner;

a support holder for holding the toner container in an axially rotatable manner;

the toner container having a toner outlet port and a magnetic member provided on an outer peripheral surface thereof;

the support holder including magnetism detection means for detecting passage of the magnetic member and for outputting a detection signal to the rotation controller;

wherein the rotation controller is configured to control the rotation driver so as to stop the toner container with the toner outlet port oriented upward with respect to a gravity direction on the basis of the output of the magnetism detection means after the toner container is rotated by the rotation driver to feed out a predetermined amount of toner from the toner outlet port;

the magnetic member includes a plurality of magnetic members arranged in spaced relation; and the rotation controller is configured to detect specifications of the toner feeder on the basis of time intervals of passage of the magnetic members.

4. A toner feeder removably mounted in an image forming apparatus including a rotation driver for rotating a toner container and a rotation controller for controlling the rotation driver, the toner feeder comprising:

a toner container for containing toner;

a support holder for holding the toner container in an axially rotatable manner;

the toner container having a toner outlet port and a magnetic member provided on an outer peripheral surface thereof;

the support holder including magnetism detection means for detecting passage of the magnetic member and for outputting a detection signal to the rotation controller;

wherein the rotation controller is configured to control the rotation driver so as to stop the toner container with the toner outlet port oriented upward with respect to a gravity direction on the basis of the output of the magnetism detection means after the toner container is rotated by the rotation driver to feed out a predetermined amount of toner from the toner outlet port;

the magnetism detection means includes a connector;

the support holder has a hollow cylindrical wall for supporting a part of the toner container provided with the magnetic member in an axially rotatable manner; and the magnetism detection means is spaced from the toner container with the intervention of the wall, and electrically connected to the rotation controller of the image forming apparatus via the connector.

* * * * *